United States Patent [19]

Di Luco

[11] Patent Number: 4,482,262

[45] Date of Patent: Nov. 13, 1984

[54] TRANSFER/CORRECTING RIBBON

[76] Inventor: Eugene Di Luco, 1760 Miriam St., North Brunswick, N.J. 08902

[21] Appl. No.: 453,495

[22] Filed: Dec. 27, 1982

Related U.S. Application Data

[63] Continuation-in-part of Ser. No. 254,627, Apr. 16, 1981, abandoned.

[51] Int. Cl.[3] ..... B41J 31/02

[52] U.S. Cl. ..... 400/240.1; 400/240.4

[58] Field of Search ..... 400/240, 240.1, 240.2, 400/240.3, 240.4, 696, 697, 697.1

[56] References Cited

U.S. PATENT DOCUMENTS

| | | | |
|---|---|---|---|
| 1,392,458 | 10/1921 | Stark | 400/240 |
| 1,960,647 | 5/1934 | Pelton . | |
| 3,141,539 | 7/1964 | Wolowitz | 400/240.1 |
| 3,143,200 | 8/1964 | Gutman | 400/240.2 |
| 3,461,998 | 8/1969 | Ploeger, Jr. | 400/240.1 |
| 3,671,287 | 6/1972 | Maniar | 400/240.1 |
| 3,752,291 | 8/1973 | Barouh et al. | 400/240.1 |
| 3,896,920 | 7/1975 | Barouh et al. | 400/240.1 |

FOREIGN PATENT DOCUMENTS

| | | | |
|---|---|---|---|
| 885813 | 12/1961 | United Kingdom | 400/240.2 |
| 961108 | 6/1964 | United Kingdom | 400/240.1 |

*Primary Examiner*—Marion E. McCamish
*Assistant Examiner*—William M. Atkinson
*Attorney, Agent, or Firm*—Daniel H. Bobis

[57] ABSTRACT

A transfer/correcting ribbon with a base or carrier strip having a semi or low tack adhesive covering substantially one entire surface thereof has at least two co-equal width strips connected to adhere thereto by pressure so as to completely cover the base strip, the base strip will have an approximate thickness of 1–3 mils and the longitudinally extending co-equal width strips will have an approximate thickness of 1.5 to 5 mils so that in assembled position, the adjacent longitudinally extending co-equal width strips will have a uniform outer surface.

4 Claims, 5 Drawing Figures

TRANSFER/CORRECTING RIBBON

This application is a continuation-in-part of my copending application Ser. No. 254,627 filed Apr. 16, 1981, now abandoned.

BACKGROUND OF THE INVENTION

1. Field of the Invention

This invention relates generally to ribbons for typewriters, adding machines, calculators and the like devices and more particularly to transfer/correcting ribbons having thereon a longitudinally extending solvent ink segment and a longitudinally extending correction material segment each respectively disposed in side by side relation along the entire longitudinal length of the correcting ribbon and in abutment with each other but nonetheless highly resistant to the bleeding of solvent inks and correction material, one into the other.

2. Prior Art

Error correcting transfer ribbons made with longitudinally extending segments therealong wherein one longitudinally extending segment has a solvent ink thereon and the other longitudinal segment is provided with a correction material are shown and described in U.S. Pat. Nos. 4,007,823; 3,896,920; 3,752,291; 4,034,843; 3,141,539; and 3,143,200.

Multi or plural color ribbons possessing two or more longitudinally extending solvent ink segments of different colors are also known as is shown in U.S. Pat. Nos. 1,392,458 and 3,671,287.

The prior art patents show that various efforts have been made in the construction and arrangement of these ribbons to overcome the problem of migration or bleeding one within the other of either solvent ink or correction material along these longitudinal segments. Bleeding impairs the operation and use of these ribbons with multiple longitudinally extending segments of adjacent solvent inks and/or solvent inks and correction materials.

In the case of error correcting ribbons, the purposes of these prior art constructions has been to prevent migration or bleeding from the longitudinally extending correction materials segment into the adjacent longitudinally extending solvent ink segment so that during the use of these error correcting ribbons, the impression made using the solvent ink segment will not be impaired by the presence of the correction material and conversely the correction material segment will not be diluted by the presence of the solvent ink therein.

The prior art patents show that in the commercial marketplace there are many suppliers of error correcting ribbons which have solved this problem by separating or spacing the longitudinally extending solvent ink segment from the adjacent longitudinally extending correction material segment by forming a window or space therebetween so as to mechanically prevent bleeding or migration of these materials one into the other.

Thus, in U.S. Pat. Nos. 4,007,823; 3,896,920 and 3,752,291, error correcting ribbons are shown wherein to insure separation of the solvent ink segment from the correction material segment, the respective longitudinally extending segments are adhered to a base or carrier strip so that a space is formed between them for example, along the longitudinal centerline of the base or carrier strip.

This construction is difficult to achieve because it requires careful and minute application to adhere the respective longitudinally extending solvent ink and correction material segments to the base or carrier strip. As a result the central or medially extending space or window between the respective longitudinally extending segment or strips is often irregularly spaced at any given transverse section of the ribbon and during use the ink impression or the correction material segment may not be sharp or it may overlap into the edge of one or the other of the respective segments or strips during the striking process as the ribbon is being used.

In U.S. Pat. No. 1,392,458, another device for maintaining the integrity of the longitudinally extending solvent ink segments one from the other is shown wherein a longitudinally extending barrier is formed between the adjacent inner edges of the respective longitudinally extending solvent ink segments.

In U.S. Pat. No. 3,141,539, a still further structure is shown in which the respective longitudinally extending solvent ink strip or segment and the correction material segment are adhered to a common base or carrier strip with an intervening protective non-absorption strip being disposed between the longitudinally extending solvent ink segment and the common base or carrier strip so that the solvent ink will not be contaminatd by the intervening adhesive for adhering the respective longitudinally extending segments to the base or carrier strip.

The present invention overcomes the problem of bleeding or migration by providing a transfer/correcting ribbon in which the base or carrier strip or member has a low tack pressure sensitive type adhesive thereon and the respective longitudinally extending solvent ink segment and correction material segment used are cured before they are adhered to the base or carrier strip under pressure.

SUMMARY OF THE INVENTION

Thus, the present invention provides an improved transfer/correcting ribbon having a relatively thin liquid impervious carrier strip or film with a low tack pressure sensitive adhesive coating thereon, a first longitudinal length of non-capillary film coated with a solvent ink, cured to fix the same thereon and having a width approximately one-half the width of the carrier strip, a second longitudinal length of non-capillary film coated with a correction material, cured to fix the same thereon and having a width approximately one-half the width of the carrier strip, said respective first and second longitudinal lengths of film material adhered by pressure to the carrier strip with their adjacent inner edges in abutment with each other, and said first longitudinal length of solvent ink and said second longitudinal length of correction material having the same thickness or caliper so that in assembled position, the upper face of the error correcting ribbon will be uniform.

Additionally, the transfer/correcting ribbon as above described wherein the adhesive on the carrier strip is non-wetting and non-penetrating relative the solvent ink and correction materials used for the respective first and second longitudinal lengths or segments of material.

Accordingly, it is an object of the present invention to provide a transfer/correcting ribbon wherein the respective longitudinally extending segments of solvent ink and correction material may be arranged in edge to edge abutment without any bleeding or blending of the respective correction material and solvent ink material thereon one into the other.

It is another object of the present invention to provide a transfer/correcting ribbon which is relatively easy to manufacture and can be produced in quantities at a relatively low cost.

These and other objects and advantages will become apparent from the following description taken in association with the accompanying drawings wherein:

DETAILED DESCRIPTION OF THE INVENTION

Figure 1:
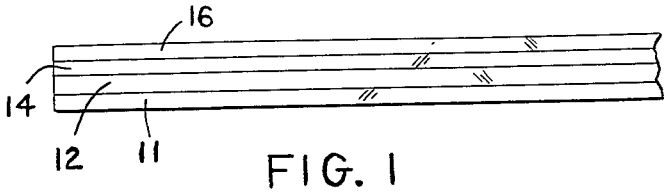
FIG. 1 is a side view showing an embodiment of the transfer/correcting ribbon in accordance with the present invention.
Figure 4:
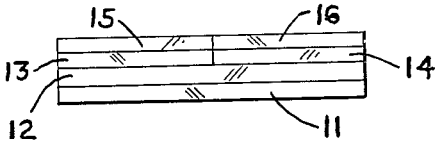
FIG. 4 is an end view of the transfer/correcting ribbon shown in FIG. 1.
Figure 2:
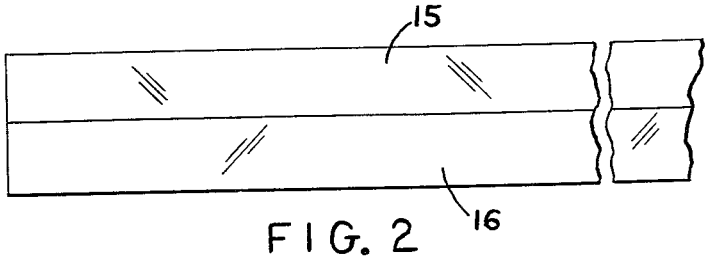
FIG. 2 is a top plan view of the transfer/correcting ribbon shown in FIG. 1.
Figure 3:
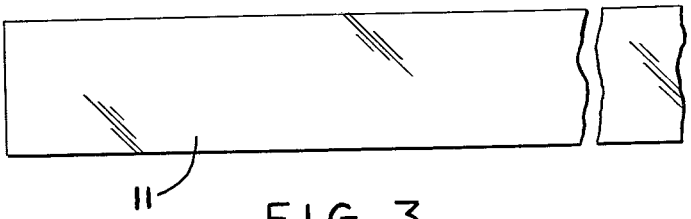
FIG. 3 is a bottom plan view of the transfer/correcting ribbon shown in FIG. 1.
Figure 5:
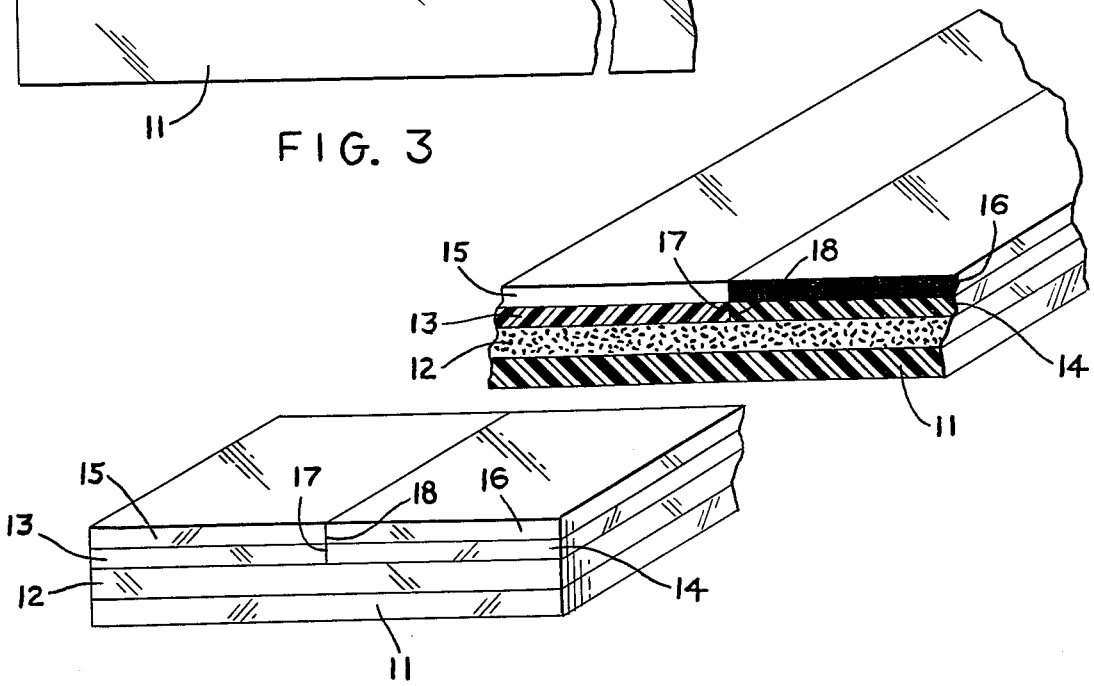
FIG. 5 is an enlarged perspective view partly broken away in cross-section showing the transfer/correcting ribbon shown in FIG. 1.

Referring now to FIGS. 1 to 5 of the drawings, a transfer/correcting ribbon in accordance with the invention is shown having a base or carrier strip 11 having a width suitable to fit the typewriter, adding machine, computer or other apparatus in which it will be used. For example, the normal typewriter ribbon will have a width of approximately one-half inch.

Base or carrier strip 11 is a longitudinally elongated relatively thin liquid impervious plastic material such as polyester film which is sold on the open market under the trademark "MYLAR". Base or carrier strip 11 is approximately 1–3 mil thick and has a low tack pressure sensitive adhesive coating thereon as at 12. The adhesive will be a synthetic rubber/resin adhesive. Base or carrier strips with this construction are purchaseable on the open market for example, from the Permacel Tape Division of Johnson and Johnson, Milltown, N.J. under their commercial designation P-924 pressure sensitive tape. This tape is an AUU white polyester film of about 1.42 mil or gauge thickness with the pressure sensitive adhesive coated on one face thereof. It is cured for a period in a range of 4–6 minutes to make it heat resistant. The total thickness of the marketed tape is 2.3 mils or gauge.

The term semi-tack or low tack as used herein is a defined term of art in the adhesive industry.

The pressure sensitive adhesive coating 12 is capable of receiving and holding a pair of co-equal width longitudinally extending strips 13 and 14 securely to the base strip 11 when the co-equal width strips 13 and 14 are forced by means of any suitable type of pressure forming assembly into engagement with the pressure sensitive adhesive coating 12 on the base or carrier strip 11.

Co-equal as used herein means that both strips 13 and 14 are of the same width so that in assembled position their combined width is equal to the width of the base strip 11. Thus, the co-equal strips 13 and 14 will be so sized that in assembled position they are aligned to cover the base or carrier strip 11. Co-equal strips 13 and 14 in the case one-half inch transfer/correcting typewriter ribbon will be one-quarter of an inch wide.

The longitudinally extending strips or segments 13 and 14 when press fitted into assembled position on the pressure sensitive adhesive coating 12 of the base or carrier strip 11 will because of their size be disposed with their longitudinally extending inner edges 17 and 18 in abutment with each other and in registration or alignment with the centerline of the base or carrier strip 11.

Thus, the adhesive coating 12 on the base or carrier strip 11 must extend on both sides of the centerline and preferably should cover the entire upper or top face of the base strip 11.

In the illustrated form of the invention one of the co-equal segments or strips 13 will have a correction material coating thereon as at 15 and the other of the co-equal segments or strips 14 will have a coating 16 of solvent ink thereon.

Each of the respective strips or segments 13 and 14 will also be made of relatively thin liquid impervious plastic material such as the same polyester film material referred to above for the base or carrier strip 11 and they will also have a thickness in a range from 1.5 to 5 mils.

Plastic films with correction material coated thereon or impregnated therein or with solvent inks coated thereon or impregnated therein are well known and are purchaseable on the open market. Each commercial form of the correction material plastic film or the solvent ink plastic films having a variety of formulations.

These plastic films of correction material or solvent ink material can be purchased in cured form on the open market either custom made in the desired widths or may be purchased in billet form and the billet split to provide the desired width for the respective longitudinally extending segments or strips 13 and 14. For example, Bee Chemical Company, of Fairfield, N.J. sells cured solvent ink polyester and/or paper films under its trademark "MULTI-STRIKE" and cured white "cover-up" correcting polyester or paper films.

Those skilled in the art will readily understand that while only two longitudinally extending segments, one of correction material and the other of solvent ink material are shown in the preferred embodiment of the present invention, that the invention is not to be so limited but that the respective longitudinally extending segments may include two or more such longitudinally extending segments and may be made of solvent ink and/or correction materials thereon depending upon the particular application to which the ribbon is to be put. This is also the case with respect to the width of the base carrier and the longitudinally extending segments or strips thereon. The criterion being that the longitudinally extending segments or strips may be co-equal to each other or may be of different widths depending upon the particular purpose and application of a given ribbon.

In the present invention the liquid impervious character of the plastic material and the use of a semi or low tack pressure sensitive adhesive on the base or carrier strip 11 will in the combination of the base carrier strip, the longitudinal segment of correction material and the longitudinal segment of solvent ink provide a product wherein due to the semi or low tack character of the adhesive on the base or carrier strip, the adhesive will not migrate or penetrate into the respective longitudinally extending segments 13 and 14 to dilute the materials therein and cause them to bleed one into the other and therefore the shelf life of this product will be extended to approximately two years which permits the ultimate retailer to maintain a reasonable inventory for their customers and provide an improved product for use by the ultimate consumer.

Further, in accordance with the present invention, the assembly of the longitudinally extending segments 13 and 14 to the base or carrier strip can be done with simple mechanical machinery in which the respective longitudinally extending segments or strips 13 and 14 and the base or carrier strip 11 are fed simultaneously between pressure rollers which press the longitudinally extending segments or strips 13 and 14 into sealing engagement with the pressure sensitive adhesive side of the base or carrier strip to form the ribbon in accordance with the present invention.

Thus a relatively simple means for providing an improved error correcting or dual transfer ribbon has been described above.

It will be understood that the invention is not to be limited to the specific construction or arrangement of parts shown but that they may be widely modified within the invention defined by the claims.

What is claimed is:

1. A transfer/correcting ribbon comprising, a. a base strip made of relatively thin liquid impervious plastic material having a low tack adhesive on one surface thereof, b. a first longitudinally extending length of relatively thin liquid impervious plastic material having a first width and a solvent ink formed and cured on one side thereof, c. a second longitudinally extending length of relatively thin liquid impervious plastic material having a second width and a correction material formed and cured on one side thereof, d. said first longitudinally extending length of solvent ink material and said second longitudinally extending length of correction material connected at the opposite sides thereof to the low tack adhesive on said one surface of said base strip by pressure, and in assembled position disposed in abutment with each other and said low tack adhesive covering the entire first and second widths of the respective first and second longitudinally extending lengths of material, and e. said first longitudinally extending length of solvent ink material and said second longitudinally extending length of correction material having the same thickness.

2. A transfer/correcting ribbon as claimed in claim 1 wherein the first longitudinally extending length of solvent ink and the second longitudinally extending length of correction material have a width equal to each other, and said width being one-half the width of the base strip whereby in assembled position the respective first longitudinally extending length of solvent ink material and said second longitudinally extending length of correction material will cover the entire face of said one surface of the base strip having the low tack adhesive thereon.

3. A transfer/correcting ribbon as claimed in claim 1 wherein, a. said base strip has a thickness of approximately 1–3 mils and, b. each of said first longitudinally extending length of solvent ink material and said second longitudinally extending length of correction material have a thickness in a range from 1.5 to 5 mils.

4. A transfer/correcting ribbon as claimed in claim 1, wherein said low tack adhesive covers the entire face of said one surface of said base strip.

* * * * *